US007121118B2

(12) United States Patent
David

(10) Patent No.: US 7,121,118 B2
(45) Date of Patent: Oct. 17, 2006

(54) HOOP EARRING AND ENHANCER MECHANISM

(76) Inventor: Zoltan David, 16827 South Ridge La., Austin, TX (US) 78734

( * ) Notice: Subject to any disclaimer, the term of this patent is extended or adjusted under 35 U.S.C. 154(b) by 41 days.

(21) Appl. No.: 10/969,776

(22) Filed: Oct. 20, 2004

(65) Prior Publication Data

US 2005/0092020 A1 May 5, 2005

Related U.S. Application Data

(60) Provisional application No. 60/602,620, filed on Aug. 19, 2004.

(51) Int. Cl.
*A44C 7/00* (2006.01)

(52) U.S. Cl. ..... 63/13; D11/40; D11/43

(58) Field of Classification Search ..... D11/40, D11/41, 75, 43; 63/12, 13, 40, 14.1–14.9
See application file for complete search history.

(56) References Cited

U.S. PATENT DOCUMENTS

| | | | | | |
|---|---|---|---|---|---|
| 3,739,599 | A | * | 6/1973 | Melone | 63/14.3 |
| D256,003 | S | * | 7/1980 | Barr | D11/43 |
| 4,386,506 | A | | 6/1983 | Stump | |
| 5,184,481 | A | | 2/1993 | Joseph et al. | |
| D393,604 | S | | 4/1998 | Webber | |
| D393,812 | S | | 4/1998 | Silveri | |
| 5,761,928 | A | | 6/1998 | Silveri | |
| 6,128,923 | A | | 10/2000 | Brams | |
| 6,508,081 | B1 | | 1/2003 | Simpson | |

* cited by examiner

*Primary Examiner*—Jack W. Lavinder
(74) *Attorney, Agent, or Firm*—Vinson & Elkins L.L.P.

(57) ABSTRACT

Earring enhancements attach to an earring such as a hoop earring and allow a decorative element to dangle at or near the center of a hoop. Enhancements may be interchangeable and may attach to a variety of earring styles.

6 Claims, 2 Drawing Sheets

HOOP EARRING AND ENHANCER MECHANISM

The present application claims benefit of priority of a U.S. Provisional Application Ser. No. 60/602620(unassigned), filed Aug. 19, 2004, and entitled, "Interchangeable Hoop Earring and Enhancer Mechanism" by Zoltan David, which is incorporated herein in its entirety by reference.

BACKGROUND OF THE INVENTION

1. Field of the Invention

The present invention pertains to the field of jewelry and in particular to earrings. More particularly, the present invention to relates to enhancements of hoop earring designs.

2. Description of Related Art

Hoop earrings have been in use throughout history in various cultures of the world. Hoop earrings of gold, silver, and bronze have been found in ancient graves in Crete, dating to about 2000 B.C. Although burying jewels along with the dead was customary at the time, the everyday use of earrings has been well documented, too, thanks to enduring images on coins, vase paintings, and terra-cotta figures.

Today, hoop earrings are available in a variety of styles that include hoops of various sizes and thickness of the hoop material, or hoops enhanced by the addition of one or more precious or semi-precious stones, set in the outer surface of hoop. There are also styles of hoop earrings in which various attachments may hang from the bottom or lower part of the hoop to dangle below the earring, for example. Additionally, various designs may be engraved into the surface of the hoop, or the hoop may incorporate designs such as hearts or crosses within the hoop structure.

In spite of the enhancements over the millennia, the hoop earring has remained basically an empty hoop, and no effective way has been found to add interest and beauty to the center of the hoop earring. This problem is exacerbated by the necessity to attach the hoop to the ear lobe, typically directly or substantially directly above the center of the hoop so that the hoop dangles directly below the ear lobe. One attempt to address the problem is described in U.S. Pat. No. 5,184,481, in which a monofilament is stretched horizontally across the opening of the hoop and various ornaments may then be attached to the wire to hang within the hoop. The '481 patent discloses that various ornaments such as a girl on a swing or animal figures may be attached to the filament in such a way that the attached ornament would swing within the earring by twisting the filament. Unfortunately, the '481 patent does not describe a way to provide easily interchangeable ornaments to an earring because it appears the ornaments are permanently crimped onto the filament. Additionally, there appears to be no way the described device could be used to present a precious stone setting or other decorative element dangling within the center of the hoop.

BRIEF SUMMARY OF THE INVENTION

The present disclosure provides a system for the enhancement of a hoop earring. The disclosed system enables different and various hanging design elements to be secured and optionally, removed from hoop earrings of various sizes.

The disclosure further provides methods and devices for attaching a hanging design element to a hoop earring such that the design is attached to the portion of the hoop designed to be behind the ear lobe when worn by a wearer. When worn by a wearer, the attachment curves around beneath the ear lobe and, in preferred embodiments dangles to the center area of the hoop.

BRIEF DESCRIPTION OF THE DRAWINGS

The following drawings form part of the present specification and are included to further demonstrate certain aspects of the present invention. The invention may be better understood by reference to one or more of these drawings in combination with the detailed description of specific embodiments presented herein.

DETAILED DESCRIPTION OF THE INVENTION

Figure 1:
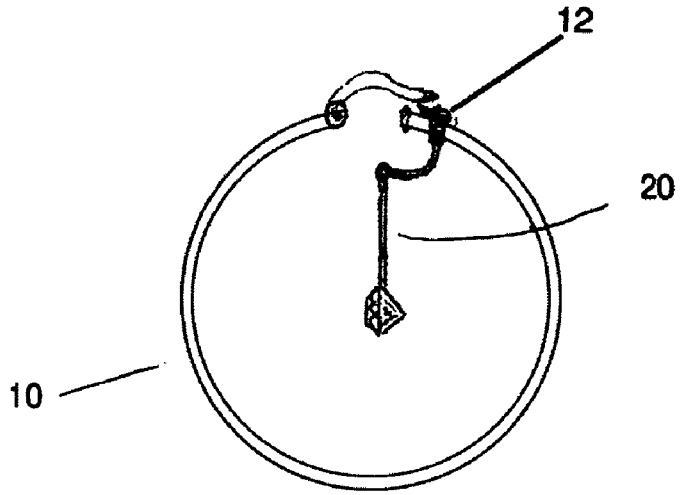
FIG. 1. is an embodiment of a hoop earring and enhancement.

The present disclosure is directed to a system of unique enhancements for hoop earrings. In its preferred embodiments the earring enhancement is a decorative element such as a stone setting or metal design that dangles into the center of a hoop earring. The dangling element preferably attaches to the hoop behind the ear lobe of a wearer and through a J-shaped or curved strut, dangles such that the design element is near the center of the hoop. It is also understood that the enhancements described herein can also be attached to the post of any type of earring and their use is not limited to hoop earrings.

Preferred embodiments may be described, therefore, as earring enhancements, the enhancements including an attachment member, configured to attach to an earring at a location behind the ear lobe of a wearer, and including a strut attached to the attachment member and configured to provide a hanger attachment for a hanger such that the hanger attachment is positioned beneath or beneath and slightly in front of the ear lobe of a wearer, and above the center of a hoop earring. A hanger is attached to the strut at one end and provides a decorative element at its opposite end, wherein the decorative element hangs to a positioned near the center of the hoop, when a hoop earring is worn. Because of the nature of the disclosed enhancements, it is understood that the position of the decorative element is under the control of gravity, and when the terms hang or dangle are used, it is assumed that the earring is in an upright position with the earring post at approximately the top of the ring, or "12 o'clock" position.

It is also understood, in light of the present disclosure, that the design element "dangles" from the hanger attachment as that word is normally understood. Dangles is taken to mean that the hanger is loosely suspended so that it sways under the influence of gravity or motion. Thus when it is stated that the design element is positioned near the center of the hoop, it is assumed that the hoop is positioned with the earring post at the top of the circle so that gravity pulls the hanger down to about the center of the hoop. It is also understood that the hanger may be shorter or longer than required to reach the exact center of the circular earring, but that preferably the hanger is aligned with the center when the earring is in the upright position as it would be when worn in an ear lobe.

In preferred embodiments, the enhancement is reversibly attached to the earring, although the attachment can be permanent, as a soldered or crimped attachment, for example. In certain preferred embodiments, however, the enhancement is easily attached and removed such that a plurality of enhancements may be interchangeably attached to a hoop or other type of earring. A most preferred embodiment includes a sleeve that is sized to slide over the hoop on the back side of the earring pin where the pin or post closes, and the sleeve is attached by a mechanism on the hoop earring, such as a spring flap. In certain embodiments, the enhancement may be attached to the post of an earring and held by the catch or clutch.

The sleeve, or other attachment mechanism is affixed to a strut or an angle strut that includes a curve such that strut curves around beneath the ear lobe of a wearer and positions a hanger attachment over the position where the center of a hoop earring is when worn. In preferred embodiments, the hanger is loosely attached to the hanger attachment element so that the hanger is free to sway or move with the movement of the wearer. One method of achieving a loose connection is by using two interlocking rings, or one ring passing through the center of a second ring, thus allowing the hanger to move loosely with respect to the strut.

The hanger is preferably an elongated member that extends from the hanger attachment to a design element located at its opposite end. It is understood that the hanger is also part of the design element and may include engraved designs, one or more precious or semi-precious stones, or other decorative elements known in the art. Preferred embodiments of the earring enhancers may include virtually any appropriate design element known in the jewelry arts attached to the lower end of the hanger. Design elements may include settings of precious or semi-precious stones, or a decorative element formed of metal or glass, for example. The enhancement is preferably composed of a material that matches or complements the material of the earring, and may be a precious metal or a precious metal alloy. Enhancements may also be composed of non-precious metals or a non-precious metal having a metal surface composed of a precious metal or precious metal alloy, or even of non-metallic materials. Preferred metals or metal alloys include but are not limited to, gold (including 24, 22 18 or 14 carat gold), silver, iridium, ruthidium, paladium, platinum (including platinum 1000 and platinum 950), copper, or steel.

In certain preferred embodiments, the present disclosure may also be described as a hoop earring with an enhancement. The hoop earring may be of any size and of any material or design known to those in the art. The hoop earring will generally include a post or pin for attachment to the lobe of a wearer. The post is typically oriented with a front and a rear side, such that the pin is placed into the pierced ear lobe from the front and protrudes from the rear where a catch or clasp holds the pin in place. In preferred embodiments of the present invention, an attachment mechanism is affixed to the earring near where the post or pin is clasped behind the ear lobe. Any type of clasp that will accept a pin may be used in the practice of the present disclosure.

In the most preferred embodiment, the enhancement includes a sleeve that slips over the earring and comes to rest against an attachment mechanism such as a spring flap, which is generally a curved element that is disposed generally parallel to the tangent of the hoop and is biased toward the hoop. A sleeve may be pushed into the flap and is held in place by the spring bias. In this way, enhancers are easily attached and removed. Such an earring is then configured to be used with any of the interchangeable enhancers as described herein.

Figure 4:
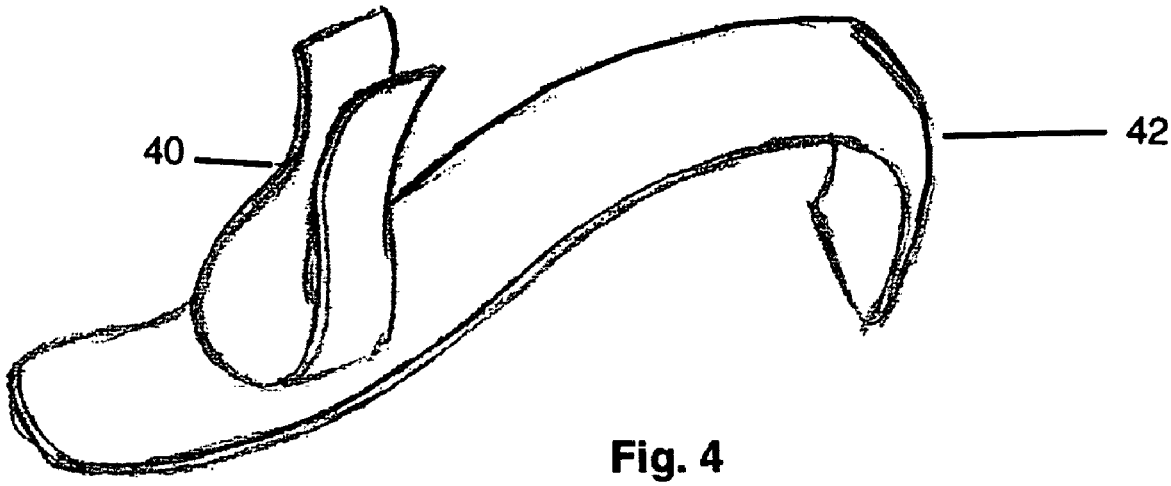
FIG. 4. is an embodiment of a spring flap that includes a spring clasp on the top thereof to hold an earring post.
Figure 5:
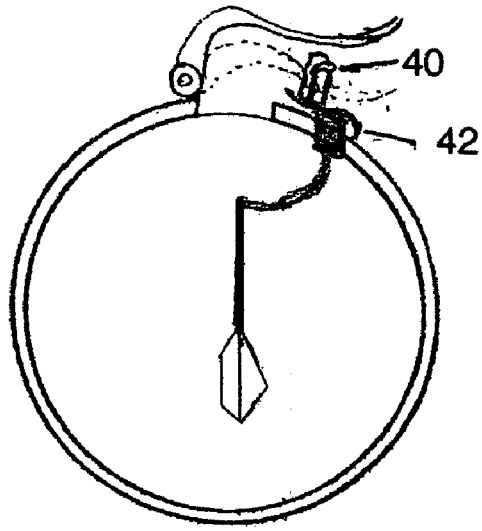
FIG. 5. is an embodiment of a hoop earring and enhancement with a combination spring flap and spring clasp.

In certain embodiments, the earring post may be held in place by a spring clasp 40. The spring clasp is generally made of two roughly parallel curved members that are biased towards each other and in which a pin may be pushed through a narrow neck region and held within the clasp by the spring bias of the members. In certain embodiments, as shown in FIGS. 4 and 5, the spring clasp 40 may be attached or affixed to the spring flap 42 that holds the sleeve of the enhancement.

The following examples are included to demonstrate preferred embodiments of the invention. It should be appreciated by those of skill in the art that the techniques disclosed in the examples which follow represent techniques discovered by the inventor to function well in the practice of the invention. However, those of skill in the art should, in light of the present disclosure, appreciate that many changes can be made in the specific embodiments which are disclosed and still obtain a like or similar result without departing from the spirit and scope of the invention.

EXAMPLE 1

An example of a hoop earring with enhancement is shown in FIG. 1. An exemplary hoop earring 10 is a hoop of approximately 2 inches diameter, made of platinum. The enhancement 20 in this example is attached to the hoop earring by a spring flap 12. The spring flap acts as a clasp or holder to secure the enhancement to the earring. In this example, the enhancement is removable and interchangeable enhancements may be attached to the earring.

Figure 2:
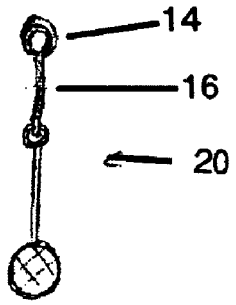
FIG. 2. is an embodiment of an earring enhancement.
Figure 3:
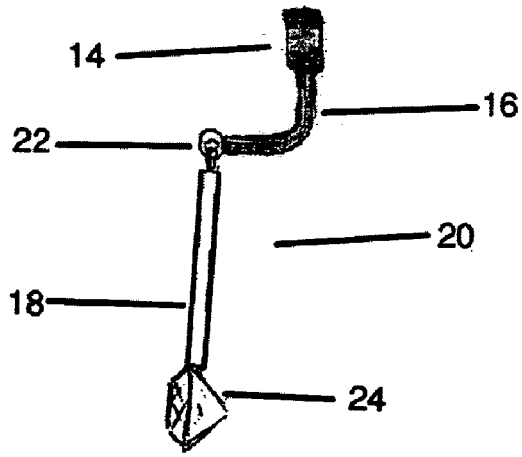
FIG. 3. is an alternative view of an embodiment of an earring enhancement.

The enhancement of this example is shown in more detail in FIGS. 2 and 3. The enhancement includes a sleeve 14, which is a flat walled tube that slips over the open end of the hoop earring and slides under the spring flap 12. A strut 16 is attached to the sleeve and positions the hanger connection substantially aligned with or slightly to the front of the ear lobe. The hanger 18 is attached to the strut by interlocking rings 22, which allows the decorative diamond setting 24 to dangle near the center of the hoop.

All of the objects and methods disclosed and claimed herein can be made and executed without undue experimentation in light of the present disclosure. While the objects and methods of this invention have been described in terms of preferred embodiments, it will be apparent to those of skill in the art that variations may be applied to the objects and/or methods and in the steps or in the sequence of steps of the methods described herein without departing from the concept, spirit and scope of the invention. All such similar substitutions and modifications apparent to those skilled in the art are deemed to be within the spirit, scope and concept of the invention as defined by the appended claims.

What is claimed is:

1. A hoop earring comprising:

a generally circular hoop comprising a post for attachment to an ear lobe and wherein the post has a front and rear orientation with respect to the ear lobe of a wearer;

an attachment mechanism for an earring enhancer located on the earring near the rear of the post, such that the attachment mechanism is behind the ear lobe of a wearer of the hoop earring, wherein the attachment mechanism is a spring flap comprising a spring clasp configured to hold the earring post; and an enhancement for the hoop earring comprising:

a sleeve sized to slide over the hoop and attach to the attachment mechanism;

a strut having first and second ends, wherein the first end is attached to the sleeve and the second end provides a hanger attachment, and wherein the strut is configured such that the hanger attachment is beneath or beneath and in front of the ear lobe of a wearer, and above the center of the hoop earring when the enhancement is attached to the hoop earring; and a hanger attached to the hanger attachment at its upper end and comprising a decorative element at its lower end, wherein the decorative element is positioned near the center of the hoop, and further wherein the hanger attachment is non-rigid such that the hanger dangles from the hanger attachment.

2. The hoop earring of claim 1, wherein the hanger attachment comprises two interlocking rings.

3. The hoop earring of claim 1, wherein the decorative element comprises one or more precious or semi-precious stones.

4. The hoop earring of claim 1, wherein the enhancement comprises a precious metal or precious metal alloy.

5. The hoop earring of claim 1, wherein the enhancement comprises gold, silver, iridium, ruthidium, paladium, or platinum.

6. The hoop earring of claim 1, wherein the enhancement comprises a non-precious metal having a metal surface composed of a precious metal or precious metal alloy.

* * * * *